US009102044B2

(12) United States Patent
Hartmann et al.

(10) Patent No.: US 9,102,044 B2
(45) Date of Patent: Aug. 11, 2015

(54) MACHINE TOOL

(75) Inventors: Markus Hartmann, Mauerstetten (DE); Aaron Wiedner, Landsberg (DE)

(73) Assignee: HILTI AKTIENGESELLSCHAFT, Schaan (LI)

( * ) Notice: Subject to any disclaimer, the term of this patent is extended or adjusted under 35 U.S.C. 154(b) by 493 days.

(21) Appl. No.: 13/469,617

(22) Filed: May 11, 2012

(65) Prior Publication Data

US 2012/0298393 A1 Nov. 29, 2012

(30) Foreign Application Priority Data

May 12, 2011 (DE) ..... 10 2011 075 765

(51) Int. Cl.
*B25D 17/06* (2006.01)
*B25D 17/24* (2006.01)
*B25D 11/06* (2006.01)

(52) U.S. Cl.
CPC ..... *B25D 17/06* (2013.01); *B25D 2211/068* (2013.01); *B25D 2217/0023* (2013.01); *B25D 2222/42* (2013.01); *B25D 2222/57* (2013.01)

(58) Field of Classification Search
CPC ..... B25D 17/06; B25D 17/24; B25D 2216/0023; B25D 11/06
USPC ..... 173/200, 204, 212
See application file for complete search history.

(56) References Cited

U.S. PATENT DOCUMENTS

| | | | |
|---|---|---|---|
| 1,167,975 | A | 1/1916 | Burlingham |
| 2,694,383 | A | 11/1954 | Larcen |
| 5,954,457 | A | 9/1999 | Stock et al. |
| 2009/0020299 | A1 | 1/2009 | Manschitz et al. |
| 2009/0133893 | A1 | 5/2009 | Zhong et al. |

FOREIGN PATENT DOCUMENTS

| | | | |
|---|---|---|---|
| AT | 175216 | B | 6/1953 |
| DE | 2726214 | A1 | 12/1978 |
| DE | 10356928 | A1 | 6/2005 |
| EP | 0841127 | A2 | 5/1998 |
| GB | 2408714 | A | 6/2005 |
| JP | 2006123025 | A | 5/2006 |

OTHER PUBLICATIONS

EP Patent Office Communication, Aug. 24, 2012 (Application No. 12163528.8), 7 pages DE Patent Office Communication, Date Unknown (Application No. 102011075765.1), 1 page.
Chinese Office Action in Chinese Application No. 201210141496.5, dated Apr. 13, 2015 (12 pages including translation).

*Primary Examiner* — Michelle Lopez
(74) *Attorney, Agent, or Firm* — McAndrews, Held & Malloy, Ltd.

(57) ABSTRACT

The machine tool according to the with a pneumatic hammer mechanism comprises a motorized exciter, a guiding tube, and a piston-shaped beater. The piston-shaped beater is guided by an interior surface of the guiding tube along an operating axis and with the exciter encloses an air spring in a guiding tube. The beater shows a cup-shaped basic body with an open hollow space facing the exciter and an inset filling the hollow space. The basic body is made from a first material with a first density and the insert is made from a material with a second density, which is lower than the first density.

5 Claims, 2 Drawing Sheets

MACHINE TOOL

CROSS-REFERENCE TO RELATED APPLICATIONS

The present application claims priority to German Patent Application DE 10 2011 075 765.1, filed May 12, 2011, and entitled "Handwerkzeugmaschine" ("Machine Tool"), which is hereby incorporated by reference in its entirety.

BACKGROUND OF THE INVENTION

The present invention relates to a machine tool with a pneumatic hammer mechanism particularly a rotary cutting chisel or a purely chiseling machine tool.

In a motor-driven pneumatic hammer mechanism a piston-shaped exciter accelerates indirectly, via an air spring, a piston-shaped beater. Seals and other lateral conditions of the hammer mechanism limit the pressure of the air spring to approximately 20 bar, thus the acceleration of the beater depends on its weight and its facial area. A hammer mechanism with a rapidly operating beater requires a light beater with a large facial area. US 2009 133893 A describes a beater showing a radially extending bore in order to reduce its weight with the facial area remaining constant.

The volume of the pneumatic chamber sets high requirements to the tolerances of the production. Any contacting of the exciter and the beater leads the hammer mechanism to fail. During the compression of the air spring the distance of the exciter from the beater reduces to approximately 1 mm, in order to generate the pressure of 20 bar necessary for the required beating performance. The high pressure leads to a local deformation of the hammer mechanism, for example the sealing ring surrounding the beater shifting and deforming. By the mechanical and thermal constant stress of the elastic sealing ring it tends to age, making it less resistant to shifting. Even a minor shifting may then lead to a sufficient displacement of the volume of the air spring with a subsequent punctual contacting of the exciter and the beater.

BRIEF SUMMARY OF THE INVENTION

One or more embodiments of the invention provide a system and method for a machine tool having a pneumatic hammer mechanism comprising a motorized exciter, a guiding tube, and a piston-shaped beater. In one embodiment, the piston-shaped beater is guided by an interior surface of the guiding tube along an operating axis and with the exciter encloses an air spring in a guiding tube. The beater shows a cup-shaped basic body with an open hollow space facing the exciter and an inset filling the hollow space. The basic body is made from a first material with a first density and the insert is made from a material with a second density, which is lower than the first density.

BRIEF DESCRIPTION OF THE DRAWINGS

The following description explains one or more embodiments of the invention based on exemplary embodiments and figures. The figures show.

Identical elements or those with identical functions are marked by identical reference characters in the figures, unless stipulated otherwise.

DETAILED DESCRIPTION OF THE INVENTION

The machine tool according to one or more embodiments of the invention with a pneumatic hammer mechanism has a motorized exciter, a guiding tube, and a piston-shaped beater. The piston-shaped beater is guided by an interior surface of the guiding tube along an operating axis and with the exciter encases an air spring in the guiding tube. The beater shows a cup-shaped basic body, with an open hollow space facing the exciter, and an insert filling said hollow space. The basic body comprises a first material with a first density and the insert comprises a material with a second density, which is lower than the first density.

The lower density of the insert allows the weight of the beater to be reduced with the facial area remaining unchanged. The cup-shaped design of the preferably stiff basic body ensures that the insert is prevented from deformation by the effects of the air spring during compression. Furthermore, the insert is only subjected to minor mechanical stress, because it is protected during the hammering process by the basic body encasing it in the direction of impact and in the circumferential direction. The completely filling insert also ensures that no parasitic air enclosures between the insert and the basic body are connected to the pneumatic chamber, in particular, when the insert is formed from an elastomer. A distance is maintained between the exciter and the beater during the compression.

One embodiment provides that the basic body encases the insert in the radial direction and in a direction facing away from the air spring. Preferably the basic body encases it entirely in all these directions; at least 95% of the surface of the insert facing in the radial direction and in the direction of impact contacts the basic body. The shape of the insert is predetermined and supported by the basic body in all spatial directions except for the direction opposite the direction of impact.

One embodiment provides that the insert ends flush with the end of the basic body facing the exciter or the insert projects from the basic body opposite the direction of impact by less than 1 mm. A surface formed by the basic body and the insert and facing the exciter may be planar. Alternatively, a preferably convex surface of the insert facing the exciter may be inclined in reference to a radial direction by less than 10 degrees. The forces applied upon the insert via the air spring primarily act only in the axial direction, thus shearing forces supporting the aging process of the insert are omitted.

One embodiment provides that the insert is embodied as cylindrical and a diameter of the insert ranges from 50% to 75% of the interior diameter of the guiding tube. One embodiment provides that a volume portion of the insert at the beater ranges from 25% to 75%.

Figure 1:
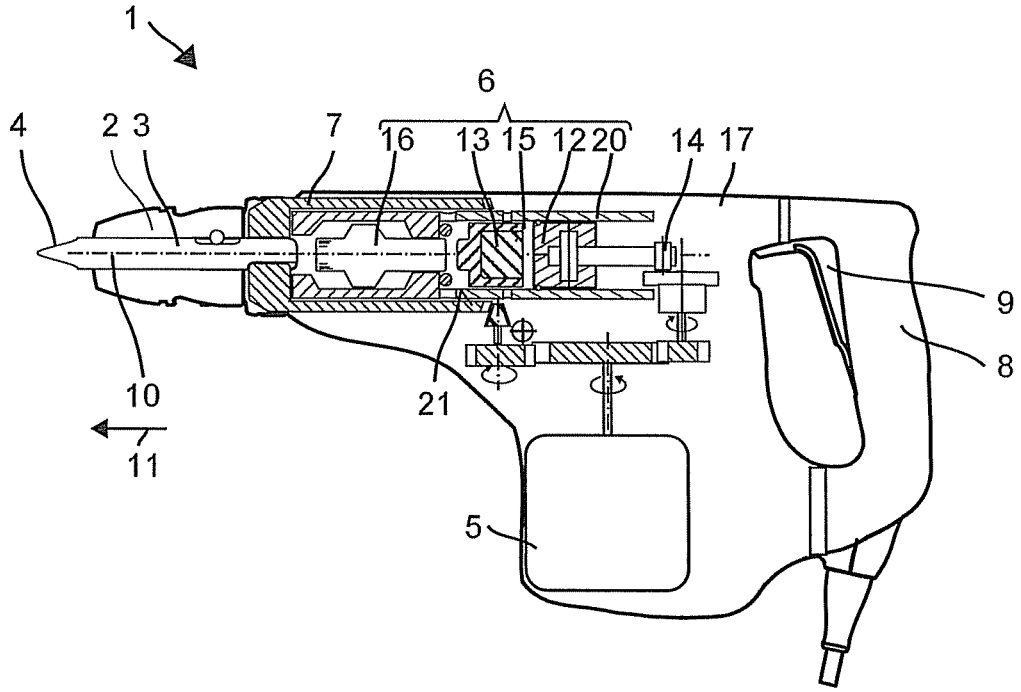
FIG. 1 shows a percussion drill.

FIG. 1 shows a percussion drill 1 as an example of a chiseling machine tool. The percussion drill 1 comprises a tool accept 2, in which the end of a shaft 3 of a tool may be inserted, e.g., a drill bit 4. A motor 5 forms the primary drive of the percussion drill 1, driving a hammer mechanism 6 and a drive shaft 7. The user may guide the percussion drill 1 via a handle 8 and operate the percussion drill 1 via a system switch 9. During operation the percussion drill 1 continuously rotates the drill bit 4 about an operating axis 10 and here the drill bit 4 may beat the underground in the direction of impact 11 along the operating axis 10.

The hammer mechanism 6 is a pneumatic hammer mechanism 6. An exciter 12 and a beater 13 are guided in a mobile fashion in the hammer mechanism 6 along the operating axis 10. The exciter 12 is coupled via an eccentric 14 or a wobble finger to the motor 5 and forced to a periodic, linear motion.

An air spring, formed by a pneumatic chamber 15 between the exciter 12 and the beater 13, couples a motion of the beater 13 to the motion of the exciter 12. The beater 13 may directly impinge the rear end of a drill bit 4 or indirectly transfer, via an essentially stationary intermediate beater 16 (riveting set), a portion of its impulse upon the drill bit 4. The hammer mechanism 6 and preferably the other driving components are arranged inside a machine housing 17.

The exemplary exciter 12 is embodied as a piston, which is moved back and forth in the cylindrical guiding tube 20. The beater 13 is also embodied as a piston. Both the exciter 12 as well as the beater 13 end flush with their radial outer surfaces at an interior surface 21 of the guiding tube 20 in an air-tight fashion. In another embodiment the exciter 12 is connected stiffly to the guiding tube 20. The exciter 12 and the guiding tube 20 are both moved to and fro by the motor 5. The cup-shaped assembly comprising the exciter 12 and the guiding tube 20 may be suspended articulate in a bearing. The beater 13 is arranged, similar to the above-mentioned embodiments, inside the guiding tube 20 and is accelerated by the air spring 15 between the exciter 12 and the beater 13.

Figure 2:
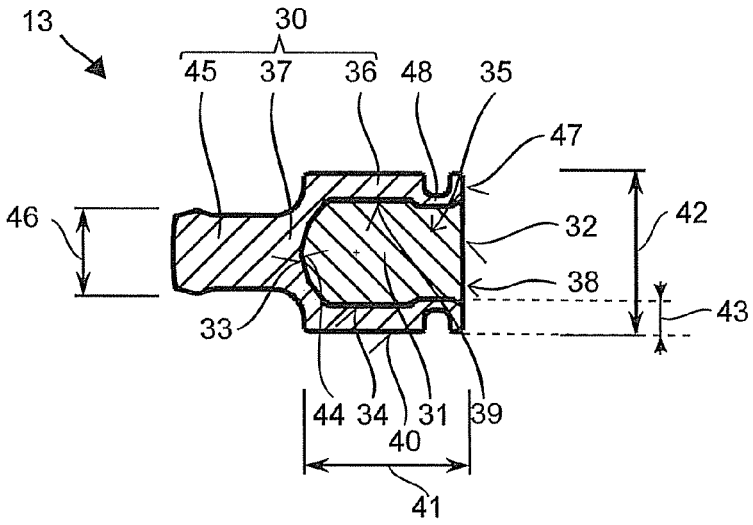
FIG. 2 shows a beater of the percussion drill.

FIG. 2 shows an exemplary beater 13 in a longitudinal cross section. The beater 13 is embodied in two parts comprising a cup-shaped basic body 30 and an insert 31 completely filling the inside of the basic body 30. The basic body 30 preferably comprises steel, the insert 31 a material with a lesser density than steel, e.g., a density of less than 5.0 g/cm$^3$. Preferred materials for the insert are elastomers, e.g., nitrile rubber (NBR), hydrated acryl nitrile butadiene rubber (HNBR), fluororubber (FPM, FKM). The insert 31 is embodied without any air enclosures, particularly not in the form of a foam, but its volume is completely filled with material, thus rendering the insert 31 incompressible.

The surface 32 of the insert 31 pointing opposite the direction of impact 11 is exposed. All other sections of the surface of the insert 31, e.g., a surface 33 pointing in the direction of impact 11, a jacket surface 34, contact an interior surface of the basic body 30. A form of the insert 31 is predetermined by the hollow space 35 of the cup-shaped basic body 30. Neither the forces when the riveting set 16 is impinged nor the pressure during the compression of the air spring deform the insert 31.

The elastic design of the insert 31 allows securely a complete filling out of the hollow space 35. Even minor air enclosures between the insert 31 and the basic body 30 may be avoided.

The cup-shaped design of the basic body 30 includes an annular, closed wall 36, which surrounds the hollow space 35 at the circumference. A floor 37 abuts the wall 36 in the direction of impact 11 and seals the hollow space 36 in the direction of impact 11. The only opening 38 of the hollow space 35 therefore points in a direction opposite the direction of impact 11.

The exemplary wall 36 may be formed by a hollow cylinder, e.g. comprising a cylindrical interior wall 39 and a coaxial cylindrical exterior surface 40. The exterior surface 40 contacts the interior surface 21 of the guiding tube 20 guided at the operating axis 10. A length 41 of the cylindrical section 36, e.g. its dimension along the operating axis 10, is preferably slightly larger than the diameter 42 of the basic body 30. The ratio of the length 41 in reference to the diameter 42 ranges for example from 0.8 to 1.2, in order to prevent any canting of the beater 13 in the guiding tube 20. The exterior surface 40 is preferably cylindrical over its entire circumference, in an alternative embodiment assembled from cylindrical segments. A wall thickness 43 of the wall 36, for example, ranges from 10% to 40% of the diameter 42 of the basic body 30.

The floor 37 may show a planar or arched interior surface 44. The exterior of the floor 37 pointing in the direction of impact 11 may be formed as a tappet 45. The tappet 45 is essentially a solid, cylindrical rod. The tappet 45 is thinner than the basic body 30, and a diameter 46 of the tappet 45 ranges for example from 30% to 50% of the diameter 42 of the basic body 30 or the beater 13. The diameter 46 is oriented on the diameter of the tools provided for the percussion drill 1.

The basic body 30 may show a radial tapping in the wall 36 or a tapping in the floor 37, which allows air to evacuate when the insert 31 is inserted. A cross-sectional area of the tappet is smaller than the facial area of the basic body 30 by a certain dimension, e.g., less than 1 mm$^2$ or less than 1% of the cross-sectional surface.

The insert 31 contacts the entire interior surface 44 of the floor 37 and the entire interior surface 39 of the wall 36. The exposed surface 46 of the insert 31 is preferably planar and ends flush with the end 47 of the basic body 30. The entire rear surface of the beater 13 is preferably planar. In a predetermined area of the facial surface a distance of the exciter 12 from the beater 13 is maximal at a predetermined pressure.

An axial bore hole or a groove extending along the operating axis 10 may be inserted in the insert 31. When inserting the insert 31 the air may evacuate along this channel. The groove reduces the cross-sectional surface of the insert 31 by less than 1%.

The insert 31 may be fastened in the basic body 30 in a form-fitting, material-engaging, and/or force-fitting fashion. A material-engaging connection may occur for example by way of adhering, molding, or vulcanizing. The insert 31 shown is inserted into the basic body 30 and is clamped by a projection 48 at the interior surface 39 of the basic body 30.

Figure 3:
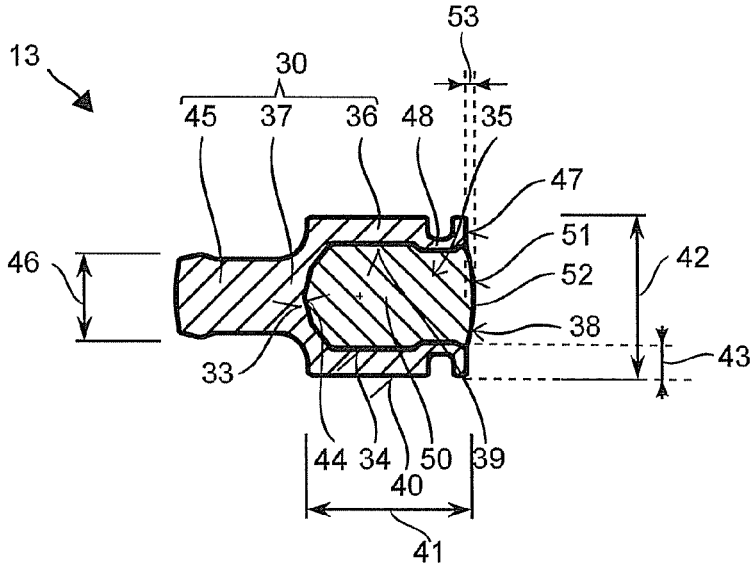
FIG. 3 shows a beater of the percussion drill.

FIG. 3 shows another embodiment of the beater 13. The insert 50 shows an exposed rear surface 51, pointing opposite the direction of impact 11, which is convex, e.g., arched away from the beater 13. The arching is minor. An incline of the surface 46 in reference to a level perpendicular to the operating axis 20 ranges from 0 degrees to 10 degrees. The zenith 52 of the arching exceeds the rear end 47 of the basic body 30 preferably by a distance 53 of less than 2 mm. The arched surface 51 preferably ends flush with the rear end 47.

Figure 4:
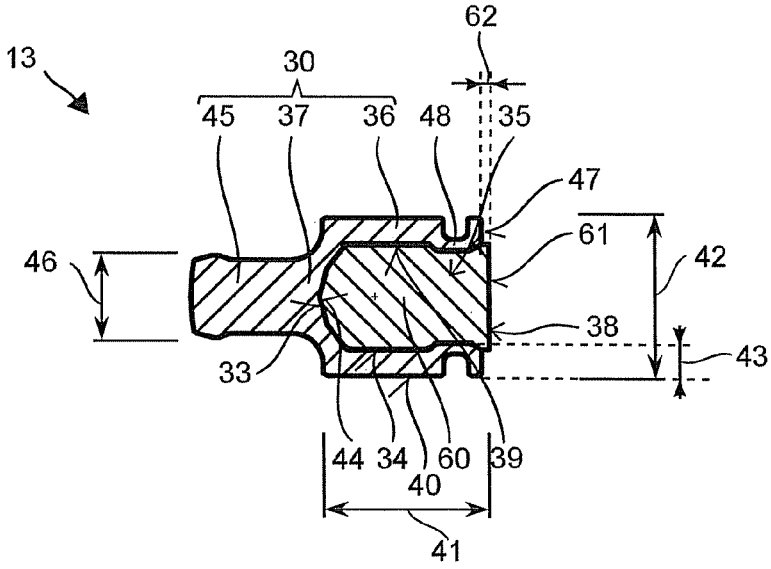
FIG. 4 shows a beater of the percussion drill.

FIG. 4 shows another embodiment of the beater 13. The insert 60 shows an exposed rear surface 61, which slightly projects beyond the rear end 47 of the basic body 30, without ending flush with the ends 47. An axial projection 62 of the insert 60 at the elevation of the wall 36 is less than 0.5 mm.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

The invention claimed is:

1. A machine tool with a pneumatic hammer mechanism, said tool including:

a motorized exciter;

a guiding tube; and a piston-shaped beater, wherein the piston shaped beater is guided through the interior area of the guiding tube along an operating axis, and wherein the exciter encloses an air spring in the guiding tube, wherein the beater includes a cup-shaped basic body with a hollow space open towards the exciter and an insert filling the hollow space, wherein the basic body encases the insert in the radial direction and in a direction facing away from the air spring and the insert ends flush with an end of the basic body facing the exciter or the insert projects from the basic body in the direction towards the exciter by less than 1 mm, wherein the basic body includes a first material with a first density and the insert is formed from an elastomer having a second density and the first density is greater than the second density.

2. The machine tool of claim 1 wherein a surface facing the exciter and formed by the basic body and the insert is planar.

3. The machine tool of claim 1 wherein a surface of the insert facing the exciter is inclined in reference to a radial direction by less than 10 degrees.

4. The machine tool of claim 1 wherein the insert is embodied cylindrically and a diameter of the insert ranges from 50% to 75% of a diameter of the beater.

5. The machine tool of claim 1 wherein a volume portion of the insert at the beater ranges from 25% to 75%.

* * * * *